US006173596B1

(12) United States Patent
Lazzaro et al.

(10) Patent No.: US 6,173,596 B1
(45) Date of Patent: Jan. 16, 2001

(54) POSITION DETECTOR FOR ROLL OF ROLLING STAND

(75) Inventors: Klaus Lazzaro, Kirchhundem; Klaus Bäumer, Kreuztal, both of (DE)

(73) Assignee: SMS Schloemann-Siemag AG, Dusseldorf (DE)

( * ) Notice: Under 35 U.S.C. 154(b), the term of this patent shall be extended for 0 days.

(21) Appl. No.: 09/435,756

(22) Filed: Nov. 8, 1999

(30) Foreign Application Priority Data

Nov. 9, 1998 (DE) ..... 198 51 480

(51) Int. Cl.[7] ..... B21B 37/58
(52) U.S. Cl. ..... 72/13.4; 72/10.1; 72/31.08
(58) Field of Search ..... 72/10.1, 10.4, 72/10.7, 13.4, 14.1, 14.4, 31.08; 73/1.79, 1.81

(56) References Cited

U.S. PATENT DOCUMENTS 4,194,383 * 3/1980 Huzyak ..... 72/13.4
5,029,400 * 7/1991 Leclercq et al. ..... 72/13.4

FOREIGN PATENT DOCUMENTS

659595 * 2/1987 (CH) ..... 72/13.4
57-103723 * 6/1982 (JP) ..... 72/10.7
61-199506 * 9/1986 (JP) ..... 72/13.4
1-53710 * 3/1989 (JP) ..... 72/13.4

* cited by examiner

*Primary Examiner*—Ed Tolan
(74) *Attorney, Agent, or Firm*—Herbert Dubno; Andrew Wilford

(57) ABSTRACT

A position detector used with a roll stand having a fixed frame member and a roll-carrying member movable in a direction relative to the frame member, has first and second sleeves telescoping in the direction adjacent the members, a mount securing one of the sleeves to one of the members, and a fixed-length but elastically bendable link rod extending in the direction and having one end fixed to the other of the members and an opposite end fixed to the other of the sleeves. Thus on relative movement of the fixed and movable members the sleeves slide in the direction in each other. A sensor rod having one end fixed in the first sleeve extends in the direction into the second sleeve. A position sensor in the second sleeve juxtaposed with the sensor rod determines a position of the members relative to each other in the direction.

5 Claims, 2 Drawing Sheets

FIG.1 – PRIOR ART

POSITION DETECTOR FOR ROLL OF ROLLING STAND

FIELD OF THE INVENTION

The present invention relates to a rolling stand. More particularly this invention concerns a position detector for the roll of a rolling stand.

BACKGROUND OF THE INVENTION

In the production of rolled goods it is extremely important to know the exact position of the rolls relative to the frame carrying them. Typically each end of the adjustable roll of a rolling stand is carried in a journal displaceable vertically on the frame. A massive hydraulic cylinder is braced between the frame and each of these journals to set the vertical position of the journal, and hence of that end of the roll, on the frame. The position detector is therefore engaged between the journal mount and the frame.

Figure 1:
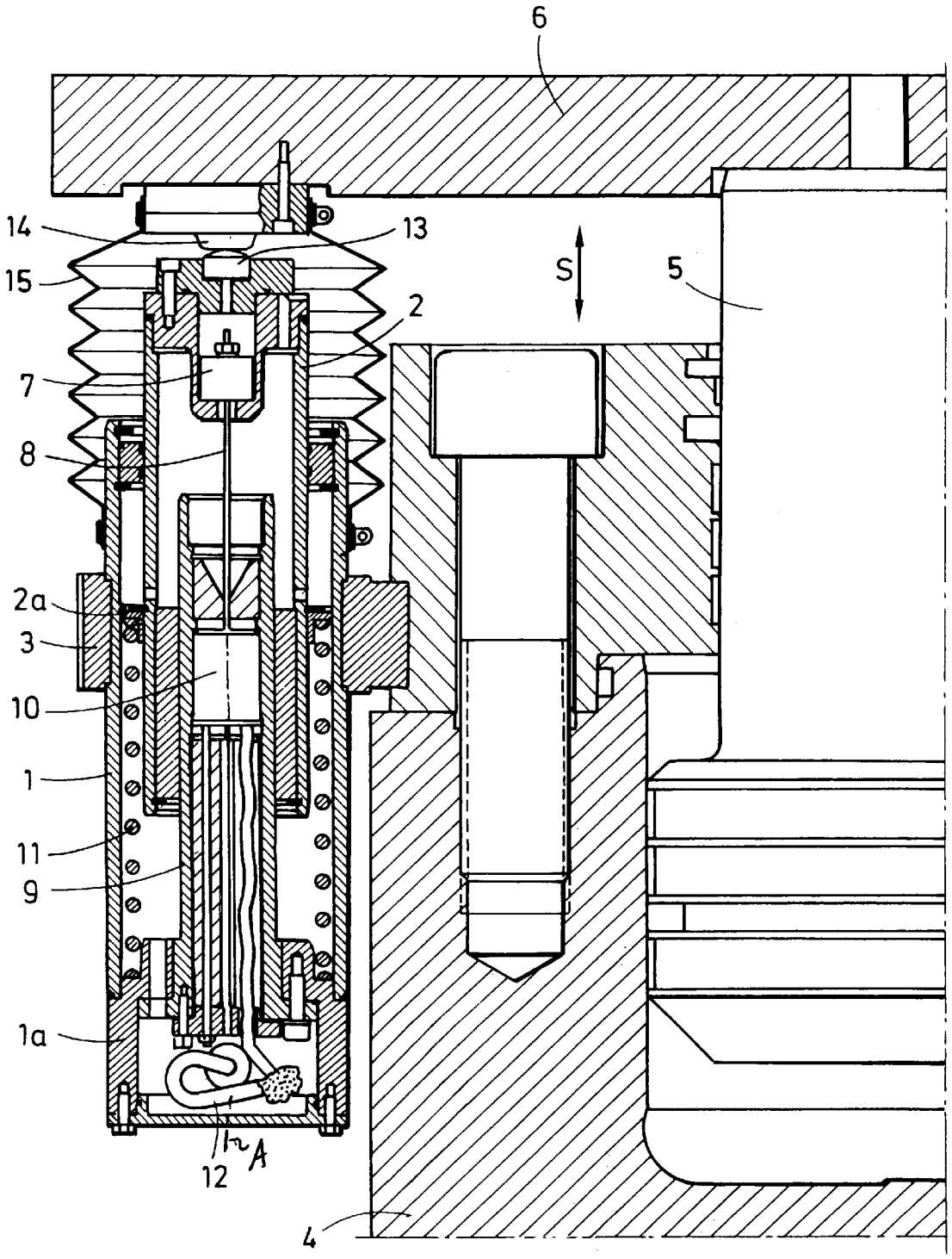
FIG. 1 is a partly diagrammatic vertical section through a prior-art rolling-stand position detector.

As shown in FIG. 1 a standard prior-art position detector comprises a lower outer sleeve 1 and an inner upper sleeve 2 telescoped together. A bracket 3 fixes the lower sleeve 1 on a mount 4 that carries the unillustrated journal for the end of the unillustrated roll. A massive hydraulic piston 5 has an upper end fixed on a stationary frame 6 and a lower end displaceable in a cylinder of the mount 4 for vertically displacing this mount 4 relative to the frame 6.

The upper sleeve 2 carries immediately beneath its upper end a holder 7 for a sensor rod 8 that extends along an axis A into an electronic position sensor 10 carried in a holder sleeve 9 fixed in the outer sleeve 1. A radially outwardly projecting flange 2*a* on the inner sleeve 2 is braced against the upper end of an axially centered coil spring 11 whose lower end is braced on a fitting la in the lower end of the outer sleeve 1 so as to continuously urge the upper sleeve 2 upward. A connection line 12 for feeding the output of the sensor 10 out to an appropriate control system extends through the fitting 1*a*.

The upper end of the upper sleeve 2 carries a button 13 with a part-spherical and upwardly convex upper surface that engages the essentially planar lower face of a contact pad 14 fixed on the stationary frame 6. A cuff 15 has an upper end secured around this pad 14 and a lower end secured around the outer cylinder 1 to keep the device clean and to allow the mount 4 and sleeves 1 and 2 carried on it to move upward and downward as shown by arrow S relative to the frame 6.

This prior-art system has several disadvantages. First of all the piston 5 is capable of exerting enormous forces that are countered by the workpiece being rolled. As a result the equipment can deform, tipping the mount 4 somewhat so the button 13 slides horizontally on the pad 14. The result is a false reading due to the changed angle.

Another difficulty is that, if the mount moves very rapidly downward, the sensor button 13 can pull away from the pad 14, causing a momentarily incorrect reading and, when it reseats on the pad 14, a reading that might also not be correct due to some minor change in position. This problem can be alleviated somewhat by making the spring 11 so powerful that it prevents any such separation of the parts 13 and 14, but such a stiff spring might falsify any readings obtained by exerting an outside force on the system being measured, while similarly falsifying readings when the two parts 13 and 14 move suddenly together.

OBJECTS OF THE INVENTION

It is therefore an object of the present invention to provide an improved position detector for a roll of a rolling stand.

Another object is the provision of such an improved position detector for a roll of a rolling stand which overcomes the above-given disadvantages, that is which provides very accurate readings of the roll position and which exerts no significant forces on the system being measured.

SUMMARY OF THE INVENTION

A position detector used with a roll stand having a fixed frame member and a roll-carrying member movable in a direction relative to the frame member, has according to the invention first and second sleeves telescoping in the direction adjacent the members, a mount securing one of the sleeves to one of the members and a fixed-length but elastically bendable link rod extending in the direction and having one end fixed to the other of the members and an opposite end fixed to the other of the sleeves. Thus on relative movement of the fixed and movable members the sleeves slide in the direction in each other. A sensor rod having one end fixed in the first sleeve extends in the direction into the second sleeve. A position sensor in the second sleeve juxtaposed with the sensor rod determines a position of the members relative to each other in the direction.

This system therefore completely eliminates the spring. Instead, the fixed-length link rod established a fixed spacing between the member to which the link rod is attached, normally the frame member, and the other sleeve, which according to the invention is the outer sleeve. If the movable roll-carrying member changes position transversely of the normally vertical axis, the link rod will deform elastically while still maintaining a fixed spacing between the other sleeve and the frame member. The link rod can be of great strength measured axially both with regard to compression and tension, so that the sleeves will perfectly follow the relative axial movements of the members. The lack of a spring also means that there is no spring force acting in addition to or against the force of the actuator moving the roll-carrying mount member.

The frame member in accordance with the invention is provided with a tubular housing open in the direction toward the sleeves and having an outer end to which is secured the one end of the link rod so that the other member is the frame member and the one member is the roll-carrying member. In this manner a relatively long link rod can be used so that resistance to lateral deflection is minor. The link-rod ends are formed as disk flanges to facilitate connection.

SPECIFIC DESCRIPTION

Figure 2:
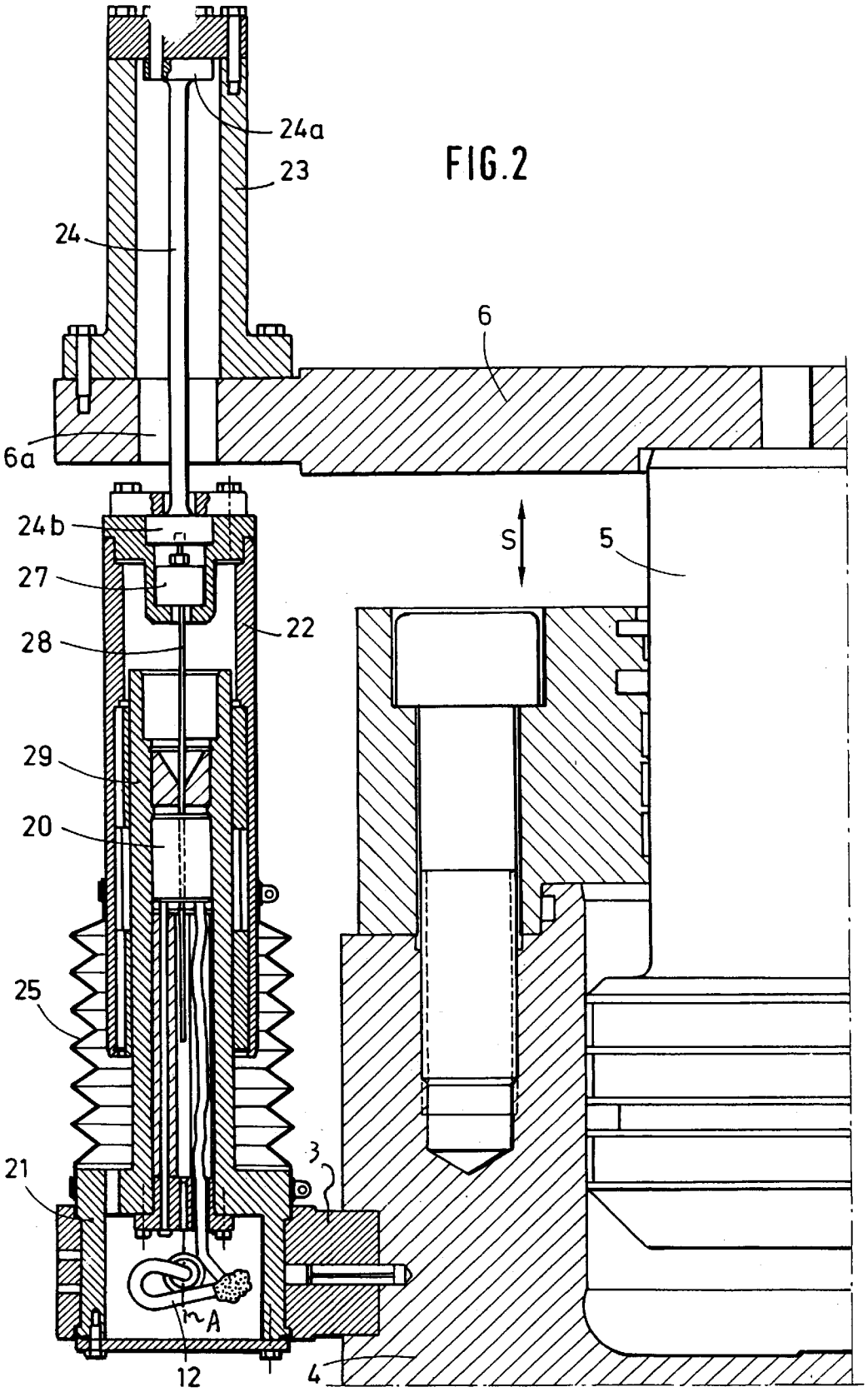
FIG. 2 is a view like FIG. 1 of the position detector according to the invention.

As seen in FIG. 2, where reference numerals from FIG. 1 have been used for structurally or functionally identical features, a position detector according to the invention has a sensor 20 held in an inner lower tube or sleeve 29 having a lower end 21 fixed by the bracket 3 to the movable roll mount 4. An upper and outer sleeve 22 that can telescope with the sleeve 29 along the axis A carries a holder 27 of an upper end of a sensor rod 28 extending along the axis A down through the sensor 20. An accordion-type cuff 25 is secured between the outer sleeve 22 and the lower-end fitting 21 of the inner sleeve 29.

In accordance with the invention a slim link rod 24 has an upper-end flange 24*a* fixed in the upper end of a downwardly open tubular housing 23 fixed to the frame 6 and a lower end flange 24*b* fixed in the upper end of the outer cylinder 22. This link rod 24 is made of steel and is somewhat flexible while being of fixed length between its end flanges 24*a* and 24*b*. It has an axial length that is equal to many times the maximum stroke of the sleeves 22 and 29 relative to each other.

In this system the sensor rod 28 along with the outer sleeve 22 will always be fixed, and the inner lower sleeve 29 will move perfectly synchronously with the movable mount 4. There is no spring urging these two parts 22 and 29 into contact with each other so that the above-discussed separation problems are wholly eliminated and the position detector exerts no significant influence on the system being measured. Furthermore if the system deforms so that the axis A of the sleeves 22 and 29 is tipped slightly, the flexibility of the link rod 24 will perfectly accommodate this relative movement so that readings taken by the sensor 20 will remain accurate. The rod 24 is thus of fixed length in that it can withstand considerable axial forces both in tension and compression, but is elastically bendable so it can be arced somewhat, as when the mount 4 moves horizontally or tips relative to the frame 6, without exerting any significant horizontal forces on the system being measured.

We claim:

1. In combination with a roll stand having a fixed frame member and a roll-carrying member movable in a direction relative to the frame member, a position detector comprising:

first and second sleeves adjacent the members telescoping in the direction;

a mount securing one of the sleeves to one of the members;

a fixed-length but elastically bendable link rod extending in the direction and having one end fixed to the other of the members and an opposite end fixed to the other of the sleeves, whereby on relative movement of the fixed and movable members the sleeves slide in the direction in each other;

a sensor rod having one end fixed in the first sleeve and extending in the direction into the second sleeve; and means including a position sensor in the second sleeve juxtaposed with the sensor rod for determining a position of the members relative to each other in the direction.

2. The roll-stand position detector defined in claim 1 wherein the link-rod one end is fixed to the frame member.

3. The roll-stand position detector defined in claim 1 wherein the frame member is provided with a tubular housing open in the direction toward the sleeves and having an outer end to which is secured the one end of the link rod, whereby the other member is the frame member and the one member is the roll-carrying member.

4. The roll-stand position detector defined in claim 1 wherein the link-rod ends are formed as disk flanges.

5. In combination with a roll stand having a fixed frame member and a roll-carrying member movable in a vertical direction relative to the frame member, a position detector comprising:

upper and lower sleeves adjacent the members telescoping in the direction;

a mount securing the lower sleeve to the roll-carrying member;

a fixed-length but elastically bendable link rod extending in the direction and having an upper end fixed to the frame member and an opposite lower end fixed to the upper sleeve, whereby on relative movement of the fixed and movable members the sleeves slide in the direction in each other;

a sensor rod having an upper end fixed in the upper sleeve and extending in the direction into the lower sleeve; and means including a position sensor in the lower sleeve juxtaposed with the sensor rod for determining a position of the members relative to each other in the direction.

* * * * *